US006095016A

United States Patent [19]

Lam

[11] Patent Number: 6,095,016

[45] Date of Patent: Aug. 1, 2000

[54] SCREW AND BOLT CLAMP DRIVE

[76] Inventor: Warren Lam, 3212 Prospect Ave., Rosemead, Calif. 91770

[21] Appl. No.: 09/153,512

[22] Filed: Sep. 15, 1998

[51] Int. Cl.[7] ..... B25B 13/06

[52] U.S. Cl. ..... 81/121.1; 81/90.3; 81/177.2

[58] Field of Search ..... 81/121.1, 90.3, 81/177.2, 901

[56] References Cited

U.S. PATENT DOCUMENTS

| | | | |
|---|---|---|---|
| 5,251,519 | 10/1993 | Lang | 81/177.2 |
| 5,263,390 | 11/1993 | Levy et al. | 81/121.1 |
| 5,327,801 | 7/1994 | Andreasen et al. | 81/177.2 |
| 5,433,850 | 7/1995 | Murray | 81/177.2 |
| 5,509,332 | 4/1996 | Donaldson, Jr. | 81/121.1 |
| 5,732,606 | 3/1998 | Chiang | 81/177.2 |
| 5,836,223 | 11/1998 | Lin | 81/177.2 |

*Primary Examiner*—David A. Scherbel
*Assistant Examiner*—Lee Wilson

[57] ABSTRACT

A screw and bolt clamp drive has an extension tube with a pair of block jaws adapted to hold different kinds of bolts and screws with a linked chain or metal strap. The screw and bolt clamp drive is used to drive the bolt or screw into a high ceiling beam without a ladder or lift. After the screw has been driven into the ceiling beam, the user pulls down on the extension tube thereby causing the block jaws to slide off the base frame to release the screw and chain. In an alternative embodiment, the block jaws may be replaced with a socket adapt or a screw drive tip. The clamp jaws are made to fit the base frame to clamp a bolt for fastening a metal strap to the ceiling beam.

2 Claims, 1 Drawing Sheet

SCREW AND BOLT CLAMP DRIVE

BACKGROUND OF THE INVENTION

In construction people fasten chains and metal straps by screws or bolts to high ceiling for suspending lights, pipes, air ducts. Most of the time, people need a ladder or lift to drive a screw into a high ceiling. Even some tools that are capable of extension do not drive a screw into a high ceiling with out ladder. Some tools may drive a screw into a ceiling with a linked piece of wire that facilitates adding a chain or strap, but the prior art does not describe a tool that can link a chain or strap to a screw and drive to them both into a high ceiling together at one time. I have invented a new tool called a screw and bolt clamp drive to solve the above-described problem.

BRIEF SUMMARY OF THE INVENTION

A base frame has jaws that can push in and slide out at top end of the base frame body for holding a screw or bolt. The base frame also connects to an extending tube. A user can hold onto the extending tube to drive a screw into a ceiling beam; or the extending tube can be driven by a drill to drive a screw into the ceiling beam. The screw and bolt clamp drive is used for driving a screw or a bolt linked with a chain or strap into a high ceiling without the use of a ladder or lift. The chains and straps are used for suspending lights, air ducts, and pipes, in construction.

DETAILED DESCRIPTION OF THE INVENTION

Figure 1:
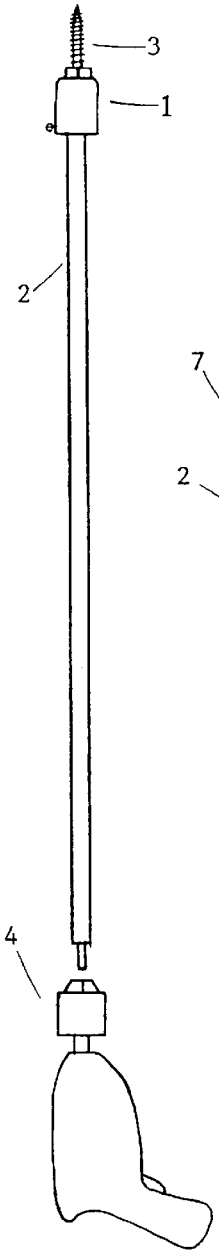
FIG. 1 is a side elevation view of a screw and bolt clamp drive being connected to an extending tube, the extending tube clamping a screw at a top end.
Figure 2:
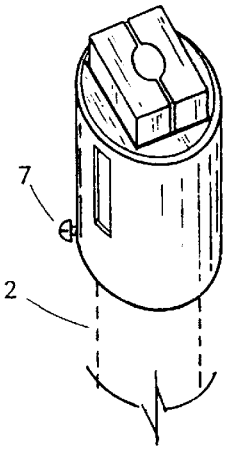
FIG. 2 is an enlarge perspective view of the screw and bolt clamp drive.
Figure 3:
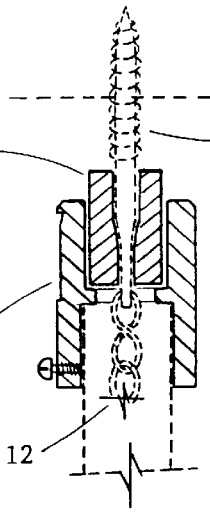
FIG. 3 is a section view of the screw and bolt clamp drive from FIG. 2, the screw and bolt clamp drive clamping a screw linked with chain.
Figure 4:
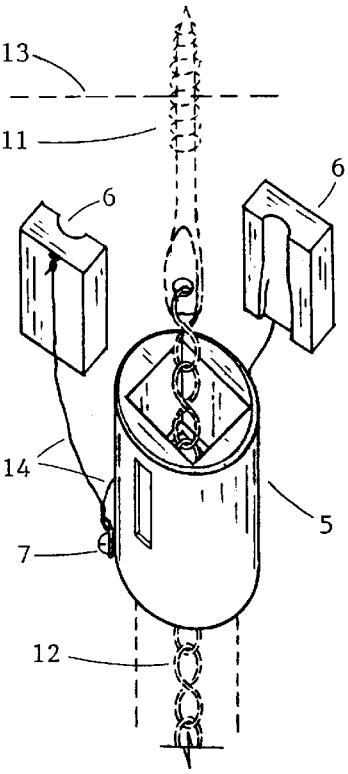
FIG. 4 is a perspective view of the screw and bolt clamp drive from FIG. 3 after the screw has been driven into the ceiling beam, and the screw and bolt clamp drive has been pulled down causing the block jaws to slide off and release the screw.

FIG. 1 is a screw and bolt clamp drive 1 connected to an extending tube 2. The screw and bolt clamp drive 1 is shown clamping a screw 3 at its top end, the screw being made ready for driving the screw 3 into a ceiling 13 by hand or with the assistance of a drill 4. Referring to FIG. 2, the screw and bolt clamp drive includes a base frame 5 having two block jaws 6 pushed into the top end of the body of base frame 5. The block jaws 6 may be made to fit and hold different kinds of screws or bolts. The lower end of the base frame 5 connects to the extending tube 2 and a screw 7 is used for tightening the base frame 5 to the extending tube 2. Referring to FIG. 3, a flat hanger screw 11 linked with a chain 12 is clamped by the block jaws 6 in the base frame 5. Referring to FIG. 4, the flat hanger screw 11 is shown once it has been driven into ceiling beam 13. Once the user has pulled down the base frame 5, the block jaws 6 slide off the base frame 5 and release the flat hanger screw 11 with the chain 12. Two aircraft cables 14 connect the two block jaws 6 to the tightening screw 7 so that the block jaws 6 do not drop down to the floor.

Figure 5:
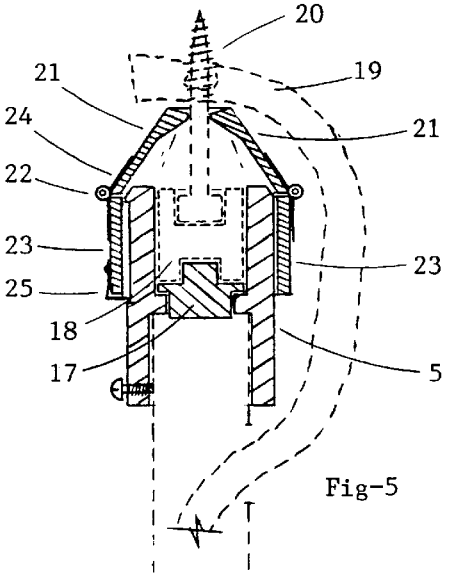
FIG. 5 is a section view of the screw and bolt clamp drive having a socket adapter and an outer clamp jaw which can hold and drive a bolt with metal strap to the ceiling beam.

Referring to FIG. 5, the screw and bolt clamp drive 1 is used for drive a screw 3 or bolt to fasten a metal strap 19 into the ceiling beam 13 without the need of a ladder or lift. The base frame 5 includes a socket adapter 17 for receiving a socket 18 or a screwdriver tip (not show). The metal strap 19 has a hole that a fastening screw 20 fits through. At least two clamp jaws 21 (may have two or more jaws) are connected to the base frame 5. Each of the at least two clamp jaws 21 is connected by a hinge 22 to a sleeve 23 of the base frame 5. A spring 24 biases each of the at least two clamp jaws 21 closed. When fastening screw 20 is driven into the ceiling beam 13, each of the at least two clamp jaws 21 hits the ceiling to push the sleeve 23 down until the base frame 5 slides up to hit and open the at least two jaws 21 and drive the screw 20 tight. A tension spring 25 prevents the at least two clamp jaws 21 from slipping off.

What is claimed is:

1. A screw and bolt clamp drive for driving a screw into a ceiling beam, the screw being attached to a chain, the screw and bolt clamp drive comprising:

an extending tube attached to a base frame;

at least two block jaws that slide into the base frame the at least two block jaws cooperating to lock the screw in place when the at least two block jaws are slidably inserted into the base frame, the screw being positioned such that the chain extends from the screw into the extending tube; and a cable attaching the at least two block jaws to the base frame.

2. A screw and bolt clamp drive for driving a screw into a ceiling beam, the screw being attached to a metal strap, the screw and bolt clamp drive comprising:

an extending tube;

a base frame attached to the extending tube with a sleeve, the base frame having a socket and socket adapter that removably engage the screw; and at least two clamp jaws hingably attached to the sleeve of the base frame, each of the clamp jaws being biased towards a closed position by a spring, the at least two clamp jaws cooperating to lock the screw in place when in the closed position, the screw being positioned such that the metal strap extends from the screw into the extending tube.

* * * * *